US005572241A

United States Patent [19]

Kanayama et al.

[11] Patent Number: 5,572,241

[45] Date of Patent: Nov. 5, 1996

[54] INK JET PRINTER CAPABLE OF DETECTING LACK OF INK

[75] Inventors: Yoshio Kanayama, Nabari; Hisashi Yoshimura, Nara; Norihiro Ochi, Yamato-Koriyama, all of Japan

[73] Assignee: Sharp Kabushiki Kaisha, Osaka, Japan

[21] Appl. No.: 410,001

[22] Filed: Mar. 23, 1995

Related U.S. Application Data

[63] Continuation of Ser. No. 35,461, Mar. 23, 1993, abandoned.

[30] Foreign Application Priority Data

Apr. 1, 1992 [JP] Japan ..... 4-079845

[51] Int. Cl.[6] ..... B41J 2/195

[52] U.S. Cl. ..... 347/7; 347/19; 347/44

[58] Field of Search ..... 347/47, 44, 7, 347/85, 19, 54, 21

[56] References Cited

U.S. PATENT DOCUMENTS

| | | | |
|---|---|---|---|
| 3,708,798 | 1/1973 | Hildenbrand et al. | 346/140 |
| 4,910,529 | 3/1990 | Regnault | 346/6 |
| 5,051,759 | 9/1991 | Karita et al. | 346/140 R |

FOREIGN PATENT DOCUMENTS

| | | |
|---|---|---|
| 0126694 | 11/1984 | European Pat. Off. . |
| 0444861A2 | 9/1991 | European Pat. Off. . |
| 2-231145 | 9/1990 | Japan . |
| 4-77264 | 3/1992 | Japan . |
| WO83/04390 | 12/1983 | WIPO . |

OTHER PUBLICATIONS

Patent Abstracts of Japan Publication No. JP5008407, Publication Date: Jan. 19, 1993.
Vol. 11 No. 250 (M–616) (2697) Aug. 14, 1987.
Vol. 12 No. 424 (M–761) (3271) Nov. 10, 1988.
"Partioned Drop–On–Demand Generator", IBM Technical Disclosure Bulletin, vol. 26 No. 9, Feb. 1984.

*Primary Examiner*—Benjamin R. Fuller
*Assistant Examiner*—Craig A. Hallacher
*Attorney, Agent, or Firm*—David G. Conlin; Milton Oliver

[57] ABSTRACT

An ink jet printer having an ink tank and nozzle passages for jetting ink therefrom. A through hole communicates with the ink tank and has a diameter which is sufficiently greater than the diameter of the nozzle passages so that air is introduced in the through hole when the pressure in the ink tank becomes negative due to a lack of ink therein and when the nozzle passages are still filled with ink. The air introduced into the through hole is detected so as to indicate a lack of ink in the ink tank.

11 Claims, 5 Drawing Sheets

INK JET PRINTER CAPABLE OF DETECTING LACK OF INK

This is a continuation of application Ser. No. 08/035,461 filed on Mar. 23, 1993, abandoned.

BACKGROUND OF THE INVENTION

1. Field of the Invention

The present invention relates to an ink jet printer, and more particularly to an ink jet printer capable of detecting lack of ink.

2. Description of the Related

A conventional ink jet printer is equipped with detecting electrodes, at a cartridge to store ink, for the purpose of detecting lack of ink after exhausted.

The cartridge is emptied, on exhausting ink, to let the air take the place of ink between the two terminals of the detecting electrodes, where lack of ink is detected by increasing resistance.

However, the above conventional method for detecting lack of ink at a cartridge is liable to leak ink at the detecting electrodes arranged at the cartridge, resulting in difficulty of keeping the reliability of the device.

Then, an ink jet nozzle, on exhausting ink, is usually removed as a whole to be replaced by a new one in many personal ink jet printers doing without detection of lack of ink, resulting in the problem of high running costs. On the other hand, the nozzle can be kept, removing only the cartridge, as an alternative, which requires lack of ink to be detected accompanied by the above problem of ink leakage, if detected e.g. at the cartridge, to complicate the structure resulting in high costs.

SUMMARY OF THE INVENTION

It is therefore an object of the present invention to provide an ink jet printer which makes it easy to detect lack of ink and is less expensive in running costs.

The object of the invention can be achieved by an ink jet printer comprising an ink tank and an ink nozzle unit, in which the ink nozzle unit communicating with the ink tank is provided with a through hole including a free end having an orifice larger in diameter than an orifice at a free end of said nozzle and a pair of electrodes are arranged in the middle of the through hole.

The ink tank is subjected to a negative pressure in the absence of ink after exhausted. Then, the free end of the through hole communicating with the ink tank is larger in orifice diameter than the free end of the nozzle communicating with the ink tank, letting the air flow into the through hole by its free end. Ink is electrically conductive, usually producing small resistance between a pair of electrodes arranged in a through hole when filled with ink. On the other hand, lack of ink is detected by increasing resistance between the electrodes in the through hole when filled with the air.

The ink jet printer of the present invention has an ink jet nozzle unit provided with a through hole, which communicates with an ink tank and includes a free end larger in orifice diameter than the free end of the nozzle, and with a pair of electrodes arranged in the middle of the said through hole, permitting ink shortage to be easily detected with high sensitivity at the ink jet nozzle and also the ink tank to be singly removed in feeding ink, thereby reducing its running costs.

Further objects and the advantages of the present invention will be apparent from the following description of the present invention will be apparent from the following description of the preferred embodiment of the invention as illustrated in the accompanying drawings.

BRIEF DESCRIPTION OF THE DRAWINGS

The present invention will be explained in detail hereunder according to embodiment as shown in drawings.

Figure 1:
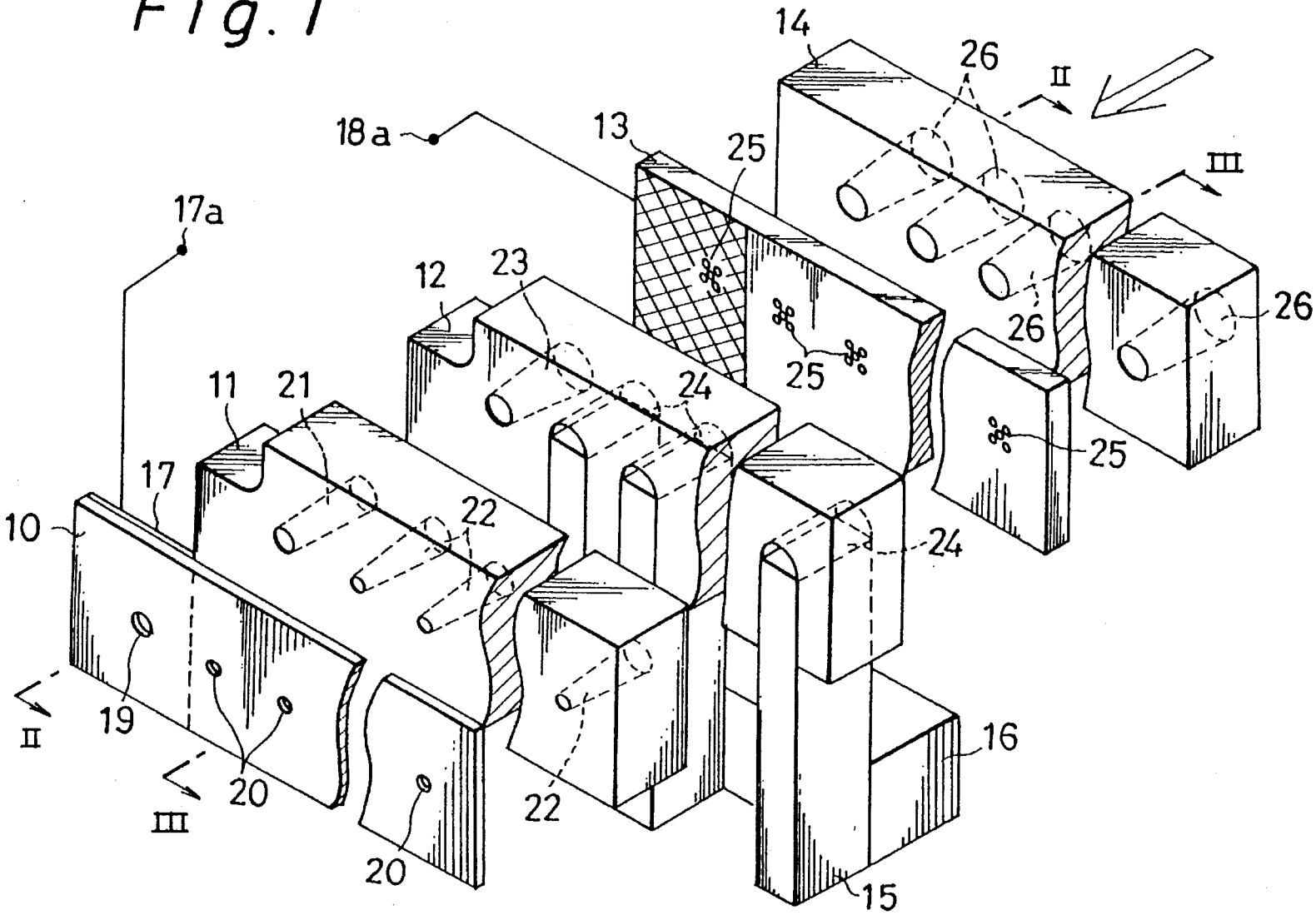
FIG. 1 is an exploded view schematically showing an embodiment of an ink jet nozzle unit of the ink jet printer according to the present invention.
Figure 2:
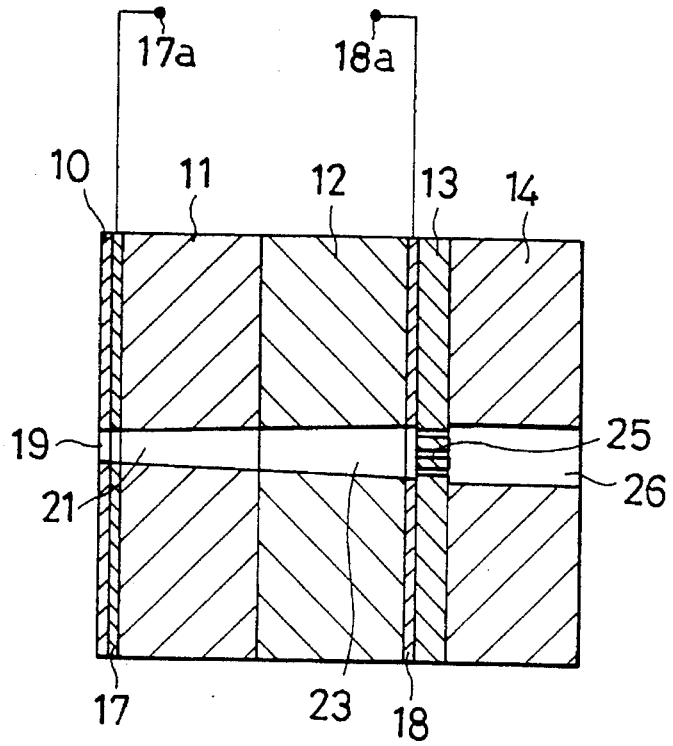
FIG. 2 shows a cross section of FIG. 1 along line II—II.
Figure 3:
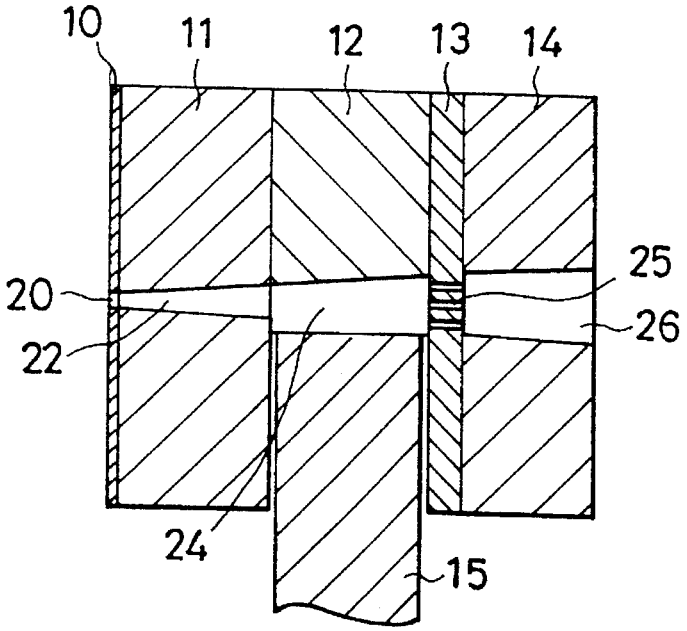
FIG. 3 shows a cross section of FIG. 1 cut along line III—III.

FIG. 1 is an exploded view schematically showing the construction of an ink jet nozzle unit of the ink jet printer of the present invention, while FIGS. 2 and 3 represent cross sections cut along lines II—II and III—III respectively.

As shown in FIGS. 1, 2 and 3, the ink jet nozzle unit is provided with orifice plate 10, nozzle plate 11, PZT plate 12, filter plate 13 and ink pass plate 14 respectively made of nonconducting materials such as glass or plastic.

Orifice plate 10 forms a free end of the ink jet nozzle unit, from which ink is jetted e.g. onto a recording sheet by means of PZT as will be mentioned later. Orifice plate 10 is provided with a single orifice 19 e.g. about 60 μm in size and a plurality of orifices 20 e.g. about 36 μm in size.

Incidentally, these orifice diameters are not necessarily limited to the above sizes, if only orifice 19 is larger than orifices 20 in size and smaller than about 150 μm.

Nozzle plate 11 is provided with nozzle-shaped through hole 21 and nozzle passage 22 corresponding to the respective orifices of orifice plate 10. Through hole 21 and nozzle passage 22 are formed into tapers having a passage diameter narrower and narrower from the inlet toward the outlet of the passage, while the outlet diameter of nozzle-shaped through hole 21 corresponding to orifice 19 of orifice plate 10 is larger than that of nozzle passage 22 corresponding to orifice 20.

PZT plate 12 is provided with a nozzle-shaped through hole 23 and a plurality of passages 24 with PZT 15 inserted thereinto. Each PZT 15 is fixed at PZT anchor block 16, permitting no ink in nozzle-shaped through hole 23 without PZT to be jetted via nozzle-shaped through hole 21 or orifice 19.

Filter plate 13 is provided with a plurality of filters 25 comprising a plurality of through holes of fine diameter, corresponding to the above mentioned nozzle-shaped through hole and nozzle passage, for the purpose of removing e.g. dust contained in ink.

Ink pass plate 14, placed where ink is introduced into the ink jet nozzle, comprises a plurality of nozzle passages 26, one of which is used for detecting lack of ink as will be later explained.

Ink pass plate 14 is further provided, on its upstream side, with an unillustrated ink cartridge to store ink.

The through hole comprising orifice 19, nozzle-shaped through hole 21, nozzle-shaped thorough hole 23, filters 25 and nozzle passage 26 is formed for detecting lack of ink, usually resulting in holdup of ink in the through hole, since nozzle-shaped through hole 23 is not provided with PZT as stated above.

It is further provided with electrodes 17 and 18 to detect lack of ink, while electrode 17 is formed on the face of orifice plate 10 around orifice 19 on the side toward nozzle plate 11 e.g. by means of deposition with Cr and electrode 18 is formed on the face of filter plate 13 around filter 25 on the side toward PZT plate 12 likewise by means of deposition with Cr.

The resistance between electrodes 17 and 18 is usually low in the presence of ink filling the through hole, while it rises in the absence of ink exhausted and replaced by the air filling the through hole comprising orifice 19, nozzle-shaped through hole 21, nozzle-shaped through hole 23, filters 25 and nozzle passages 26, as will be later explained, permitting lack of ink to be detected. Electrodes 17 and 18 are respectively connected by means of connecting terminals 17*a* and 18*a* to an electric circuit for detection of lack of ink, as will be later explained.

Figure 4:
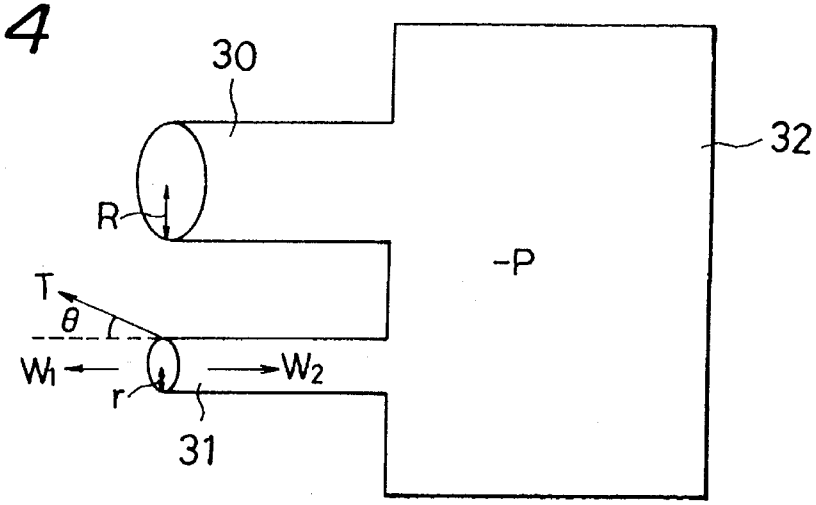
FIG. 4 explains the principle of detection of lack of ink in the ink jet printer of the present invention.

FIG. 4 explains the principle of detection of lack of ink in the ink jet printer of the present invention.

Lack of ink is detected at the above through hole by a difference in surface tension of ink resulting from a difference in orifice diameter.

For an equilibrium on the meniscus of passage 31 in case of negative pressure (–P) applied inside ink puddle 32 in a system comprising passages 30 and 31 different in diameter from each other, the component of the total surface tension in the longitudinal direction of passage 31 is defined as:

$$W_1=2\pi rT\cos\theta$$

where T represents surface tension per unit length working on the periphery of the ink in passage 31; θ represents a contact angle which is the angle between the line in the direction of T and the wall surface of passage 31; and r represents a radius of passage 31. The total surface tension working on the whole periphery of the ink in passage 31 is 2πrT and the component of T in the longitudinal direction of passage 31 is Tcosθ.

Internal negative pressure: $W_2 = \pi r^2 P$
and $W_1 = W_2$
Hence $P = 2T\cos\theta/r$ Then, passage 30 is subjected to the force $$\begin{aligned} W_1 - W_2 &= 2\pi RT\cos\theta - \pi R^2 P \\ &= 2\pi(R/r)T\cos\theta \cdot (r-R) < 0 \end{aligned}$$

on its meniscus, where R represents a radius of passage 30, yielding itself to the back pressure to introduce the air from its free end.

Therefore, the ink jet printer according to the above embodiment permits lack of ink to be easily detected with high sensitivity at its ink jet nozzle unit and an ink cartridge storing ink to be singly removed in feeding ink, thereby reducing its running costs.

Figure 5:
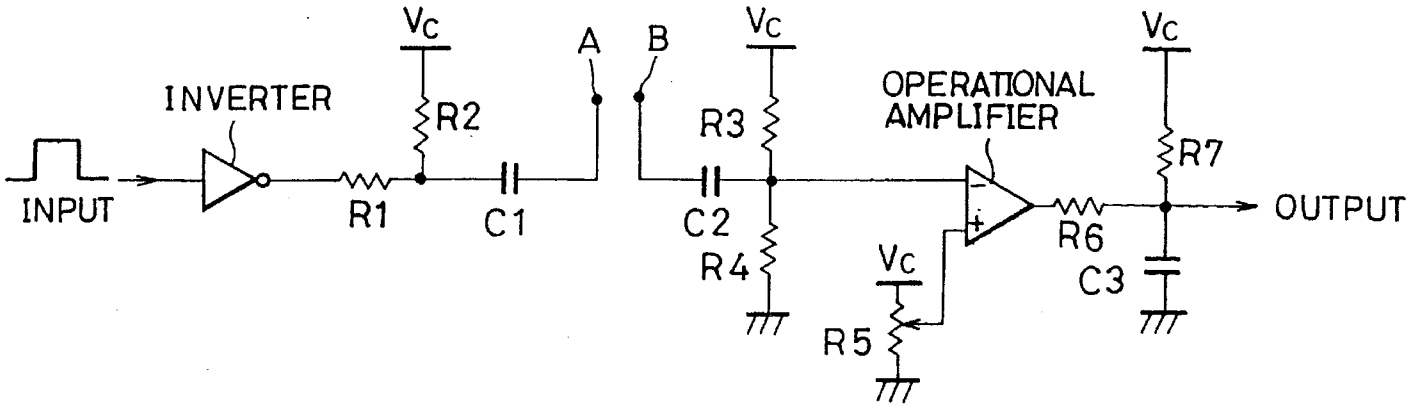
FIG. 5 shows an example of electric circuit for detecting lack of ink.
Figure 6:
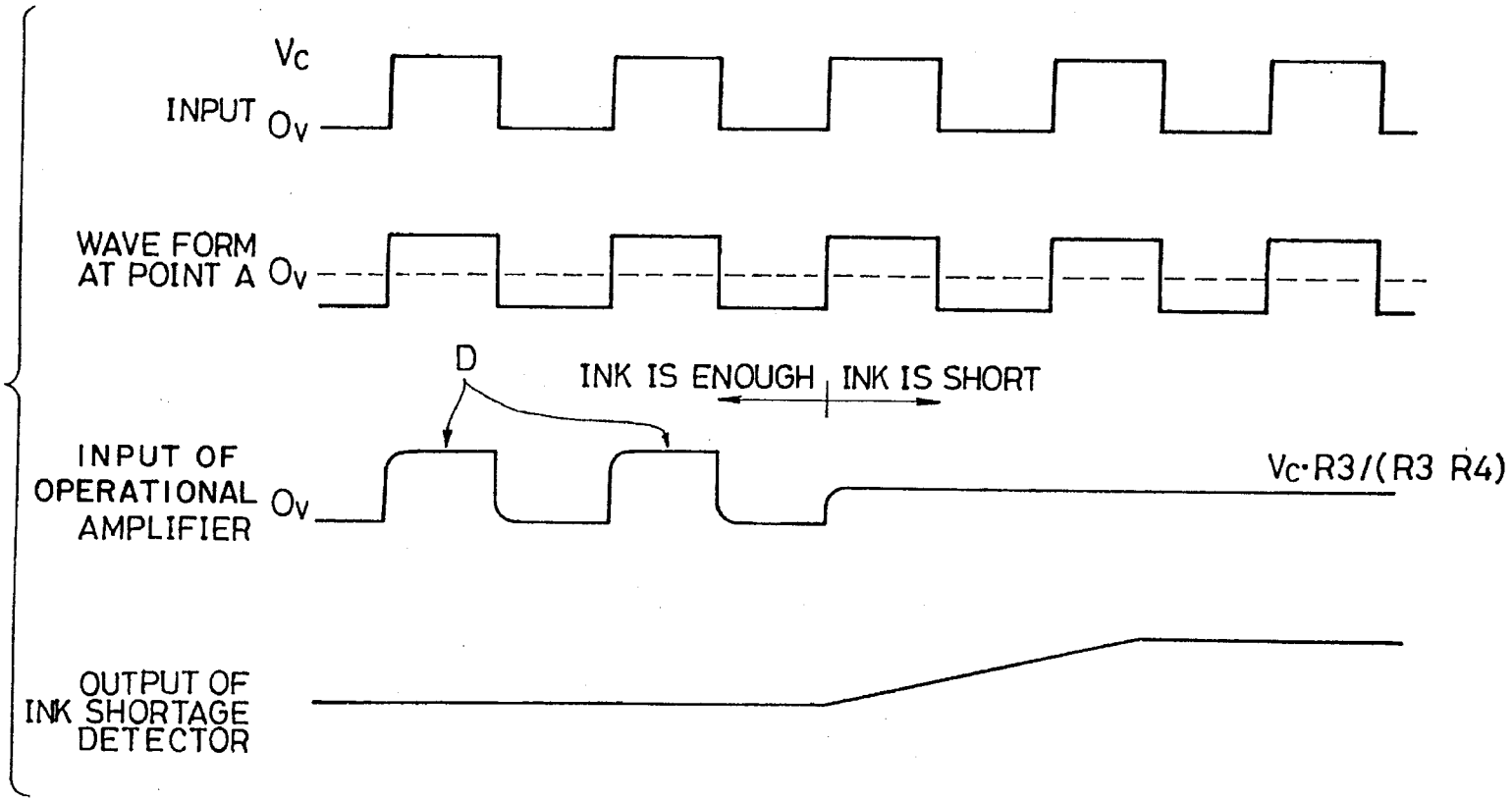
FIG. 6 exemplifies an electric signal of the electric circuit of FIG. 5.

FIG. 5 shows an example of electric circuit for detecting lack of ink, while FIG. 6 exemplifies an electric signal of the electric circuit of FIG. 5.

R1 to R7 represent values of resistors, C1 to C3 represent values of capacitators, and $V_c$ represents a value of the voltage of a power supply.

An inputted pulse wave is level-shifted by an inverter, resistances R1, R2 and capacitor C1 to be transmitted to terminal A, while the level shift is effected, as shown in FIG. 6, so as to repeat the same wave form between + and – relative to the ground for avoiding electrolysis of ink.

Terminal A is connected to terminal 17*a* as shown in FIG. 1, while terminal B is connected to terminal 18*a*. As stated above, terminals A and B are in conductive contact with each other usually with ink. Therefore, a pulse wave is inputted, on reaching terminal A, to an operational amplifier by means of terminal B, while a pulse as denoted by D in FIG. 6 is inputted to – terminal of the operational amplifier. On the other hand, the resistance between terminals A and B rises in the presence of the air introduced into the through hole on exhaustion of ink, while the input at – terminal is divided by R3 and R4 to be represented by the formula $V_C \cdot R3/(R3+R4)$. For example, the operational amplifier receives an input of 2.5 V, if $V_C$=5 V and R3=R4.

The operational amplifier has a low-level output only as long as the operational amplifier has an input of D at – terminal, in the presence of ink, if $V_C$=5 V and a voltage on the order of 3.5 V is applied as a reference voltage to the input of the + terminal of the operational amplifier. However, the output signal remains permanently low in setting CR (C3 and R6) to have a large time constant at the output of the operational amplifier.

On the other hand, the operational amplifier permanently has a high-level output in the absence of ink, to emit a high-level signal after a lapse of time represented by the time constant of CR, thereby detecting lack of ink.

Figure 7:
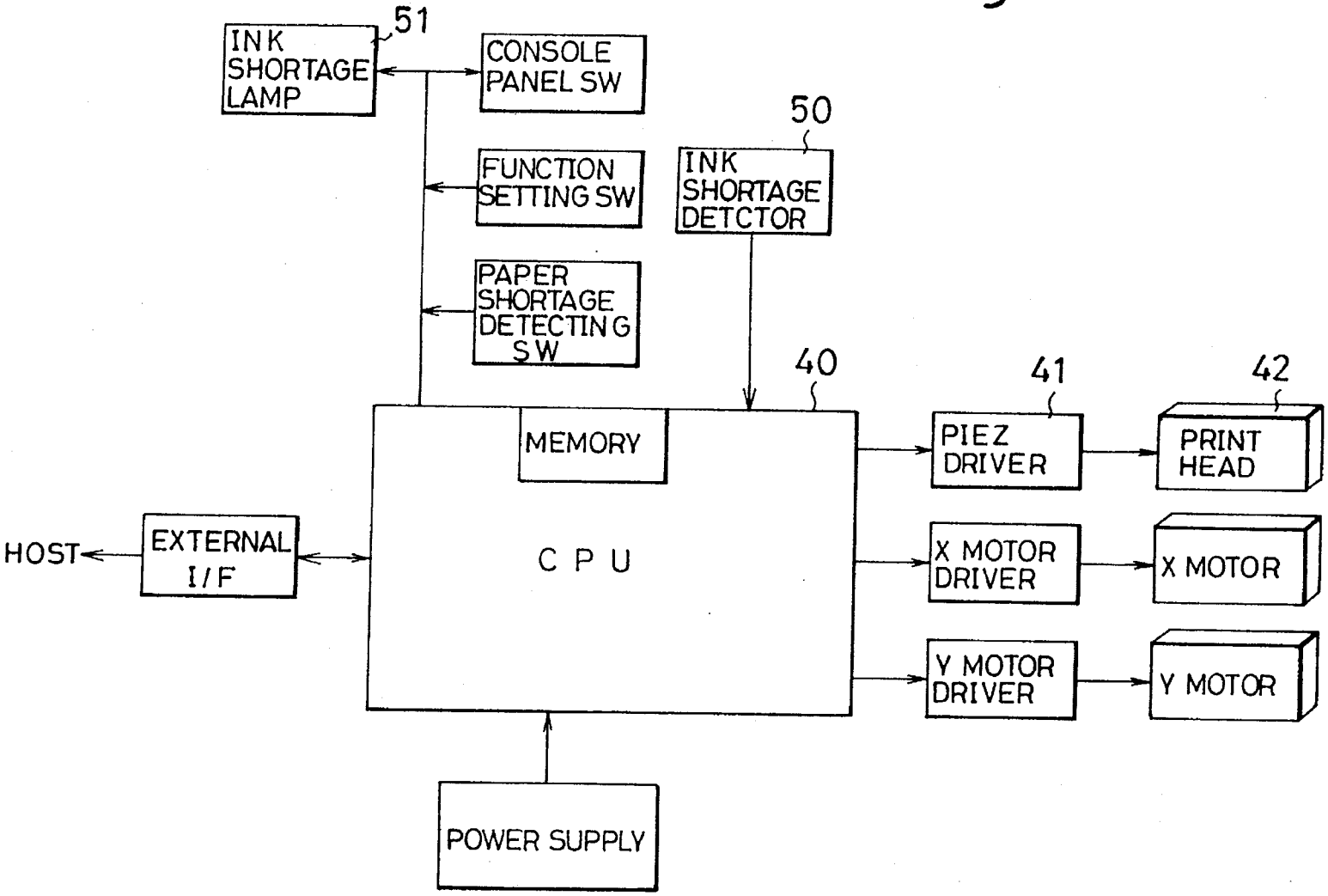
FIG. 7 is a block diagram roughly showing an example of the controller in the ink jet printer according to the present invention.

Now, the present invention will be explained according to an example of controller of an ink jet printer, FIG. 7 is a block diagram exemplifying a controller of an ink jet printer.

The controller comprises CPU40, connected e.g. to piezo-driver 41 driving PZT of printhead 42 including an ink jet nozzle unit, also ink shortage detector 50 including an electric circuit for detecting lack of ink as shown in FIG. 5 and ink shortage lamp 51 both connected to CPU40.

In the absence of ink after exhausted, ink shortage detector 50 has a high-level output to inform CPU40 of ink shortage. Then, CPU40 puts a light to ink shortage lamp 51 to inform an operator of ink shortage. The operator sets a new ink cartridge and switches off ink shortage lamp 51 by means of a switch (as unillustrated) connected to CPU40, thereby starting e.g. cleaners arranged all over the ink jet nozzle unit to suck detecting orifices in order to introduce ink from the ink cartridge into the ink jet nozzles and the through hole for ink shortage. Then, it is newly filled with ink between detecting electrodes, where the resistance is remarkably lowered, while ink shortage detector 50 has a low-level output, so that CPU40 turns off ink shortage lamp 51.

As explained above in detail, the ink jet printer of the present invention has an ink jet nozzle unit provided with a through hole, which communicates with an ink tank and includes a free end larger in orifice diameter than the free ends of the nozzles, and with a pair of electrodes arranged in the middle of the said through hole, permitting ink shortage to be easily detected with high sensitivity at the ink jet nozzle unit and also the ink tank to be singly removed in feeding ink, thereby reducing its running costs.

Many widely different embodiments of the present invention may be constructed without departing from the spirit and scope of the present invention. It should be understood that the present invention is not limited to the specific embodiment described in the specification, except as defined in the appended claims.

What is claimed is:

1. An ink jet printer comprising:

an ink tank storing an electrically conductive ink;

a plurality of nozzle passages communicating with said ink tank arranged in parallel to one another for jetting said ink from a front end of said ink jet printer;

a through hole, communicating with said ink tank, arranged along and in parallel to said plurality of nozzle passages, said through hole having a diameter at the front end of said ink jet printer that is greater than a diameter of each of said nozzle passages at the front end of said ink jet printer in order to draw air into said through hole more quickly than air is drawn into said nozzle passages when a pressure in said ink tank becomes negative due to a lack of said ink and when said nozzle passages are still filled with said ink; and detecting means, disposed in said through hole, for detecting the air introduced in said through hole even if said ink passages are still filled with said ink.

2. An ink jet printer according to claim 1, wherein each of said nozzle passages and said through hole are provided with orifices at the ends thereof, the diameters of said orifices corresponding, respectively, to the diameter of said through hole and the diameters of each of said nozzle passages.

3. An ink jet printer according to claim 2, wherein the diameter of the orifice of said through hole is greater than the diameters of the orifices of each of said nozzle passages and is smaller than 150 micrometers.

4. An ink jet printer according to claim 3, wherein the diameter of the orifice of said through hole is diameters of the orifices of each of said nozzle passages is 36 micrometers.

5. An ink jet printer according to claim 2, wherein each of said orifices is arranged on an orifice plate.

6. An ink jet printer according to claim 5, wherein said nozzle passages and said through hole are tapered towards the free ends thereof.

7. An ink jet printer according to claim 6, further comprising a piezoelectric plate provided with a hole without a piezoelectric element, forming a part of said through hole, and further provided with holes with piezoelectric elements, each forming a part of each of said nozzle passages.

8. An ink jet printer according to claim 7, further comprising a filter plate provided with a plurality of filters formed of a plurality of fine holes, each filter forming a part of said through hole and each of said nozzle passages.

9. An ink jet printer according to claim 1, wherein said detecting means comprises a pair of electrodes disposed in said through hole for detecting the air introduced into said through hole by detecting a change in electric resistance between said electrodes.

10. An ink jet printer according to claim 8, further comprising a pair of electrodes provided in said through hole for detecting the introduction of air into said through hole by detecting a change in electric resistance between said electrodes, one of said electrodes being formed on said orifice plate and the other electrode being formed on a face of said filter plate on a side facing said piezoelectric plate.

11. An ink jet printer according to claim 2, wherein said detecting means comprises a pair of electrodes disposed in said through hole, for detecting the air introducted into said through hole, by detecting a change in electric resistance between said electrodes.

* * * * *